US006763117B2

(12) United States Patent
Goldslager et al.

(10) Patent No.: US 6,763,117 B2
(45) Date of Patent: Jul. 13, 2004

(54) SPEAKER ENCLOSURE

(76) Inventors: Barry Goldslager, 96 Vernon St., Gardner, MA (US) 01440; Philip A. Goldslager, 4516 Queen Anne St., New Albany, OH (US) 43054; Philip W. Goldslager, 4516 Queen Anne St., New Albany, OH (US) 43054

( * ) Notice: Subject to any disclaimer, the term of this patent is extended or adjusted under 35 U.S.C. 154(b) by 257 days.

(21) Appl. No.: 09/964,941

(22) Filed: Sep. 27, 2001

(65) Prior Publication Data

US 2003/0063766 A1 Apr. 3, 2003

(51) Int. Cl.[7] ..... H04R 25/00

(52) U.S. Cl. ..... 381/345; 381/348; 381/349; 181/156

(58) Field of Search ..... 381/337, 345, 381/346, 348, 349, 351, 352, 353, 354, 162; 181/151, 155, 156, 187, 196, 197, 198, 199

(56) References Cited

U.S. PATENT DOCUMENTS

| | | | |
|---|---|---|---|
| 2,921,993 | A | 1/1960 | Beaverson |
| 3,765,504 | A | 10/1973 | Itoh |
| 3,779,337 | A | 12/1973 | Gregory |
| 4,168,761 | A | 9/1979 | Pappanikolaou |
| 4,280,019 | A | 7/1981 | Propst et al. |
| 4,437,541 | A | 3/1984 | Cross |
| 4,569,414 | A | 2/1986 | Fulton |
| 4,591,020 | A | 5/1986 | Hruby, Jr. |
| 4,800,983 | A | 1/1989 | Geren |
| 4,869,340 | A | 9/1989 | Coudoux |
| 4,889,208 | A | 12/1989 | Sugihara |
| 4,898,260 | A | 2/1990 | Fang |
| 5,025,886 | A | 6/1991 | Jung |
| 5,333,204 | A | 7/1994 | Hamada et al. |
| 5,373,564 | A | 12/1994 | Spear et al. |
| 5,659,155 | A | 8/1997 | Porzilli |
| 5,661,271 | A | 8/1997 | Moser |
| 5,764,782 | A | 6/1998 | Hayes |

OTHER PUBLICATIONS

*Closed–Box Loudspeaker Systems Part I: Analysis*, Richard H Small, Journal of the Audio Engineering Society, pp. 285–295.

*Cabinet Construction: Shape and Damping*, Vance Dickason, The Loudspeaker Design Cookbook, pp. 79–84.

*The Use of Fibrous Materials in Loudspeaker Enclosures*, L.J.S. Bradbury, Journal of the Audio Engineering Society, pp. 404–412.

*Encyclopedia of Acoustics*, Malcolm J. Crocker, vol. 4, pp. 1910–1911.

*High Performance Loudspeakers*, Martin Colloms, Colloms Electroacoutics, UK, pp. 11–12.

*Primary Examiner*—Huyen Le
(74) *Attorney, Agent, or Firm*—Watts Hoffmann Co., L.P.A.

(57) ABSTRACT

An enclosure assembly for use in an audio speaker includes a driver support, a plurality of cavity forming layers disposed rearward of the driver support, and an end piece disposed adjacent a rearward most cavity forming layer. The driver support includes a front and rear and is adapted to support a driver. Each cavity forming layer includes an outer peripheral edge and a void disposed inward of the outer peripheral edge. The void defines an inner circumferential edge. The cavity forming layers may be removably joined such that the voids and the end piece cooperate to form a cavity rearward of the driver support. The cavity forming layers cooperate to advantageously modify the sound performance of the speaker, while providing a high degree of adjustability to the speaker's application environment. Methods of providing the enclosure assembly are also included.

18 Claims, 11 Drawing Sheets

SPEAKER ENCLOSURE

FIELD OF THE INVENTION

The present invention relates generally to audio speaker enclosures. More specifically, the invention is directed to an improved audio speaker enclosure having cavity forming layers which cooperate to advantageously modify the sound performance of the speaker, while providing a high degree of adjustability to the speaker's application environment.

BACKGROUND OF THE INVENTION

The performance of an audio speaker may be measured in terms of fidelity, or the degree in which an electronic system reproduces sound without distortion. Resonance and vibrations within the audio speaker will effect the measured performance of the speaker. It is known in the art that the structure of the audio speaker itself can effect the resonance and vibrations within the audio speaker. Conventional speaker enclosures are designed with this principle in mind.

Conventional audio speakers typically include at least one driver mounted within an external face of the enclosure. As the driver projects sound into the application environment, e.g., a room in the case of a home stereo, rearward advancing sound waves travel within the speaker enclosure. Various solutions have been proposed for increasing sound absorption and reducing sound reflection at the walls of the enclosure. Several solutions involve the formation of a cavity within the speaker enclosure to reduce resonance and increase speaker fidelity.

One of these solutions is to form a speaker enclosure from a plurality of structural layers so as to create separate chambers for various drivers. The chambers are formed by the cooperation of internal openings within the structural layers. Vibration dampening layers are interspersed between the separate chambers to attenuate vibrations and prevent interactions between the drivers in separate chambers. This solution incorporates several tension rods to hold together the structural layers. This construction does not facilitate the quick addition and removal of layers to modify sound response without removing drivers. Individual layers can not be removed, modified and reinstalled without disassembling the enclosure.

Another solution proposes employing a series of structural layers to create two enclosure volumes within a speaker enclosure. A primary chamber defines a principal interior volume of the enclosure while a secondary chamber defines a minor interior volume. The minor interior volume is substantially smaller than the principal interior volume. This solution does not disclose a speaker assembly with a high degree of adjustability allowing for the advantageous modification of the frequency response produced by the speaker.

As a practical matter, a speaker installer is currently limited by the speaker in its factory issued condition. There remains a need in the art for an improved audio speaker enclosure assembly that can advantageously modify the sound performance of the speaker, while maintaining a high degree of flexibility and adjustability to adapt to a variety of application environments.

SUMMARY OF THE INVENTION

The present invention is directed to an improved audio speaker enclosure having cavity forming layers which cooperate to advantageously modify the sound performance of the speaker. The invention provides a high degree of adjustability to adapt to a variety of application environments.

In one embodiment of the present invention, an enclosure assembly includes a driver support, a plurality of cavity forming layers and an end piece. The driver support has a front and a rear and is adapted to support a driver. The plurality of cavity forming layers are disposed rearward of the driver support. The end piece is disposed adjacent a rearward most cavity forming layer.

Each cavity forming layer comprises an outer peripheral edge and a void disposed inward of the outer peripheral edge. The void is defined by an inner circumferential edge. A plurality of the cavity forming layers is removably joined such that the voids and the end piece cooperate to form a single cavity rearward of the driver support. The cavity has an inner circumferential surface defined by the inner circumferential edges of the cavity forming layers. The individual cavity forming layers can be added or removed to change a volume of the cavity.

In another embodiment of the present invention, an enclosure assembly includes a driver support having a front and a rear and adapted to support a driver, a plurality of cavity forming layers disposed rearward of the driver support, and an end piece disposed adjacent a rearward most cavity forming layer, wherein the end piece terminates the cavity.

Each cavity forming layer comprises an outer peripheral edge and a void disposed inward of the outer peripheral edge. The void is defined by an inner circumferential edge. The cavity forming layers and the end piece cooperate to form at least one cavity rearward of the driver support. The cavity has an inner circumferential surface defined by the inner circumferential edges of the cavity forming layers. At least one cavity forming layer has a void having an area that is different from an area of a void of at least one other cavity forming layer.

In yet another embodiment of the present invention, an enclosure assembly includes a driver support having a front and a rear and adapted to support a driver, a plurality of cavity forming layers disposed rearward of the driver support, and an end piece disposed adjacent a rearward most cavity forming layer, wherein the end piece terminates the cavity.

Each cavity forming layer comprises an outer peripheral edge and a void disposed inward of the outer peripheral edge, wherein the void is defined by an inner circumferential edge. The cavity forming layers and the end piece cooperate to form at least one cavity rearward of the driver support. The cavity has an inner circumferential surface defined by the inner circumferential edges of the cavity forming layers. At least one cavity forming layer has a void having a shape that is different from a shape of a void of at least one other cavity forming layer.

A method of the present invention is also included. The method comprises the first step of measuring a set of acoustical parameters. The set defines the application environment.

The method comprises the second step of assembling an enclosure assembly in accordance with an embodiment of the present invention. A third step comprises modifying an actual sound response produced within the application environment by at least one of the following steps; adding at least one removably joined cavity forming layer, deleting at least one removably joined cavity forming layer, or modifying an inner circumferential edge of at least one cavity forming layer. The modified cavity forming layer cooperates to form an inner circumferential surface of the at least one cavity.

In one embodiment, the method steps are performed on-site within the application environment.

Other objects and advantages and a fuller understanding of the invention will become apparent to those skilled in the art from the following detailed description of the preferred embodiments and the accompanying drawings.

DESCRIPTION OF THE INVENTION

Figure 1A:
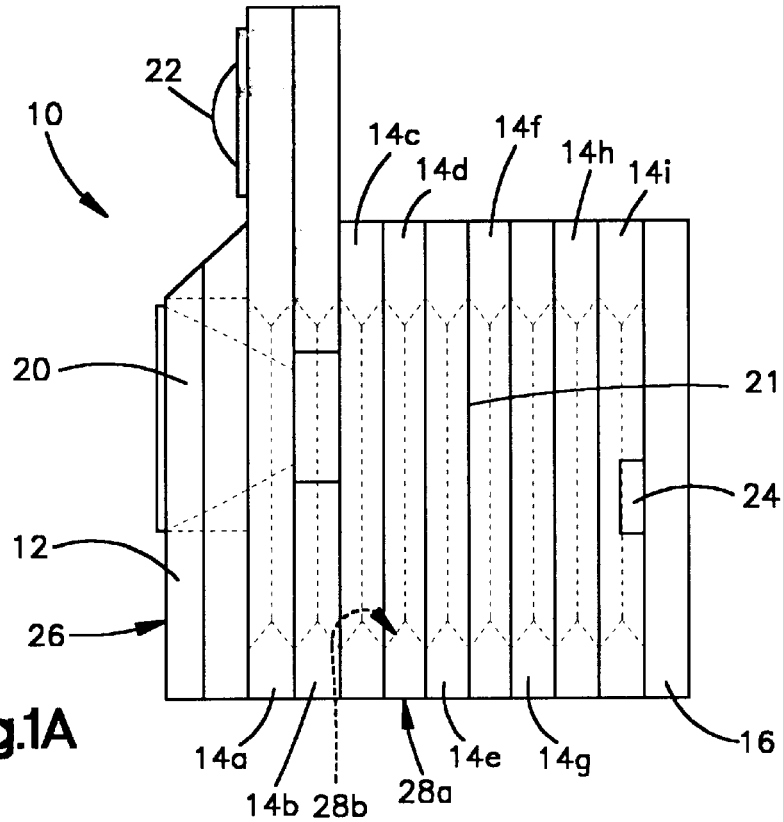
FIG. 1A is a vertical sectional view of a first enclosure assembly of the present invention, showing a single cavity disposed rearward of the driver support.

The present invention is directed to an improved audio speaker enclosure having cavity forming layers which cooperate to advantageously modify the sound performance of the speaker, while providing a high degree of adjustability to the speaker's application environment. The enclosure functions by modifying rearward advancing waves within the enclosure. In the case of home audio speakers, the enclosure generally functions to cancel out the rearward advancing waves.

The enclosure assembly includes a driver support, a plurality of cavity forming layers and an end piece. The cavity forming layers include an outer peripheral edge and a void disposed inward of the outer peripheral edge. The void itself is defined by an inner circumferential edge. The cavity forming layers and the end piece cooperate to form a cavity rearward of the driver support. Individual cavity forming layers can be added or removed to change the volume or the shape of the cavity. As a result, the volume, size, and shape of the cavity is adjustable to produce a desired sound performance of the speaker within the speaker's application environment. In applying the invention in the context of a home audio, the enclosure assembly is conventionally referred to as a speaker cabinet. However, in other contexts the foregoing elements can be configured in any suitable manner, e.g., hearing aids, automobiles, auditoriums, or any other context or application apparent to one skilled in the art in view of this disclosure.

The invention can be configured into enclosures of nearly any size, ranging from hearing aids to auditorium size systems. In experimental testing, to be discussed in more detail below, an enclosure of the present invention has exhibited excellent bass extension, midrange and high range clarity, and excellent sound staging, laterally, vertically, and in depth. These benefits can be measured and quantified by several techniques, including the use of an accelerometer to show changes to the surface of the enclosure, as in waterfall plots. Commercial software, such as Loudspeaker Lab II and Audioprecision I, are available for overall performance measurements, including impedance, cabinet resonance and driver resonance. Other benefits of the invention may also be exhibited, such as advantageous effects upon the resonance of the enclosure, distortion caused by the enclosure, the transient response of the drivers, and the inertness of the enclosure. The specific benefits of an enclosure of the invention include anti-resonance characteristics and exceptional clarity in frequencies including and beyond the capabilities of human hearing.

As stated, an enclosure of the present invention includes a driver support having a front portion and a rear portion. The driver support is adapted to support a driver. The driver may be any device conventionally referred to as a speaker, a cone, a woofer, a subwoofer, a diaphragm or a dome. Various types of driver and loading combinations can also be used. For example, a horn loaded loudspeaker, a direct radiator loudspeaker, a monopole loudspeaker, a dipole loudspeaker, a bipole loudspeaker, a bass reflex loudspeaker, a bandpass loudspeaker, a passive radiator loudspeaker, and a transmission line loudspeaker may be utilized. It should be appreciated by those skilled in the art that the preceding lists are provided for purposes of example rather than limitation. Other cavity driver and loading combinations will be apparent to one skilled in the art in view of this disclosure. Therefore, it is to be understood that, within the scope of the appended claims, other driver and loading combinations can be utilized when practicing the invention otherwise than as specifically shown and described.

The invention also allows for adjustments and modifications as improved drivers become available. The invention permits driver upgrades to be installed without otherwise sacrificing performance. After an upgraded driver is installed, the method of the invention can be practiced to optimize speaker performance with the newly upgraded driver. This feature advantageously allows a user to periodically upgrade the driver without replacing the entire speaker cabinet.

The driver is mounted within the driver support to load the speaker, and to keep rearward traveling waves from canceling or combining with forward traveling waves. Sound waves traveling within the enclosure can cause resonances of the enclosure which tend to decrease speaker fidelity. The driver support may be disposed in a forward facing surface in the enclosure, or itself form the forward most element of the enclosure. The driver support may be the first structure layer in a home audio speaker. In other contexts, the driver support may be any suitable structure or element to which the driver may be mounted. The driver support may be any size, shape, or configuration, so long as its functions to support the driver. The driver may be mounted to the driver support with hardware, adhesive, or other suitable means. Another electrodynamic audio device, such as a tweeter, may be mounted elsewhere within the enclosure in a forward facing surface.

The enclosure further includes a plurality of structural layers. The layers include cavity forming layers comprising an outer peripheral edge and a void disposed inward of the outer peripheral edge. The void is defined by an inner circumferential edge. At least some cavity forming layers are removably joined such that the voids and the end piece cooperate to form a single cavity rearward of the driver mounted to the support. The cavity has an inner circumferential surface defined by the inner circumferential edges of the cavity forming layers.

In a preferred embodiment, the layers are substantially planar and are preferably generally transverse, and still more preferably, perpendicular to an axis extending transversely to the plane of the layers. The axis may also be a longitudinal axis of a cavity formed by the layers. The cavity may also be generally cylindrical, dependent on the size and shape of the loudspeaker. The structural layers may comprise a material selected from wood, particle board, plastic, metal, a polymeric material, combinations thereof, or any other suitable material apparent to others with ordinary skill in the art in view of this disclosure. The layers may be any suitable thickness. The length and width of the layers will generally be a function of the overall enclosure size.

The cavity forming layers include an outer peripheral edge. This outer edge is typically a parallelogram, such as a rectangle or square in the case of home audio speakers, although it could be circular or any other possible shape suitable for construction as would be the case in, for example, a hearing aid. Depending on the application, other edge shapes may be used that are apparent to those with ordinary skill in the art in view of this disclosure. The cavity forming layers also include a void disposed inward of the outer peripheral edge. The void is defined by an inner circumferential edge. A cavity within an enclosure is formed when a series of cavity forming layers is joined so that the voids cooperate to form a cavity. The cavity may be generally cylindrical in shape. It may also be rectangular in shape, or otherwise irregular in shape.

The voids in each cavity forming layer of an enclosure may all be equal in size and shape. In alternative embodiments, one or more layers may include a void of a different shape, a different area, or both. The size and shape of each void will be chosen to effectuate the desired speaker performance. The shape of the speaker cabinet is dictated by sound projection restraints, overall loudness, physical size constraints and room dimensions. For example, for a narrow home listening room, a narrow loudspeaker system would be used so as to not clutter the room, and achieve good stereo separation, depth perception and overall loudness. This system may have a certain height so that the tweeter height would align with a listener's ear. Because such a system would be narrow and tall, the interior cavity would also be narrow and tall. In other words, the chosen shape of the cavity is somewhat dependent on the chosen shape of the cabinet. Those of ordinary skill in the art will know how to optimize cabinet design in view of the instant disclosure, as would be apparent from industry texts such as *The Loudspeaker Design Cookbook* by Vance Dickason, 5$^{th}$ Edition, Audio Amateur Press, Peterborough, N.H., 1995, *Encyclopedia of Acoustics,* Malcolm J. Crocker, Editor-in-Chief, John Wiley & Sons, Inc., New York, N.Y., 1997, and *High Performance Loudspeakers*, by Martin Colloms, 5$^{th}$ Edition, John Wiley & Sons, Inc., New York, N.Y., 1997, all of which are incorporated herein by reference. Several commercially available software programs directed toward cabinet size determination are also available, including LEAP™ Version 4.6 from Linear X Systems Inc., 7556 SW Bridgeport Road, Portland, Oreg. 97224, and BassBox™ Version 5.1 from Harris Technologies, P.O. Box 622, Edwardsburg, Mich. 47112, both of which are incorporated herein by reference.

The voids within the structural layers may be made by machining, stamping, laser cutting, or created by any other suitable method. The voids may be created prior to assembly in a production and assembly facility. Alternatively, the voids may be individually created at the application site just prior to assembly. When an installer desires to modify the enclosure to a specific application environment, the voids may be modified on-site to effectuate the desired speaker performance. Alternatively, prefabricated layers may be added or deleted on site to obtain the desire performance.

In a preferred embodiment, the modification of the cavity is performed by adding or removing structural layers. The overall shape of the cavity can be modified by adding, subtracting or substituting layers having voids of differing areas and/or shapes to shape the frequency response for a particular loud speaker to match a particular frequency response desired in a particular room.

The cavity forming layers may be removably joined or permanently fixed upon assembly. Advantageously, in one embodiment, layers may be added or deleted to effectuate sound wave response of the driver without removing drivers. Tension or structural rods are not required. This feature allows adjustment of sound response without the time consuming disassembly of the entire enclosure or speaker Preferably, the enclosure assembly also includes an end piece disposed adjacent a rearward most cavity forming layer. The end piece is generally substantially planar and cooperates with the cavity forming layers to form at least one cavity rearward of the driver support. However, the end piece does not have to be imperforate. In an enclosure assembly including more than one cavity, a single end piece may be used. In an alternative embodiment, each cavity includes a separate, dedicated end piece. The end piece may be constructed of similar or different material than the cavity forming layers. The end piece may be removably joined or permanently fixed to the rearward most cavity forming layer. The end piece may include small holes, ports, vents or other structural features for mounting. Adding end pieces will make a loudspeaker more inert and less prone to resonances.

Another aspect of the invention is a method of providing an enclosure assembly for use in an audio speaker, specifically modified for an application environment. The method of the present invention includes the steps of measuring a set of acoustical parameters, assembling an enclosure in accordance with an enclosure assembly of the present invention, and modifying an actual sound response produced within the application environment.

A conventional speaker includes an enclosure and produces a measurable sound wave response within an application environment. The method of the present invention seeks to design and assemble an enclosure suited for a targeted application environment, then modify the enclosure to effectuate a specific sound wave response for that environment. The modification is typically done by modifying the inner circumferential edge of at least one cavity forming layer, or adding, deleting or substituting cavity forming layers having the pre-fabricated voids as required. In home audio systems and in larger environments, such as auditoriums, stadiums and churches, the desired effect is improved bass linearity and a flatten frequency response.

A first step of the method of the present invention includes measuring a set of acoustical parameters. The set of parameters define the application environment and include frequency. One possible procedure to measure the acoustical parameters is as follows. A loudspeaker system is set up in a room location as dictated by an end user. A microphone is set up at ear level of a listener in a typical listening position. The microphone is connected to a conventional spectrum analyzer, such as a LMS manufactured by Linear Systems or model SA-3052 by AudioControl Industrial. Next, a pink noise signal or frequency sweep is fed to the loudspeakers and the frequency response is measured. The frequency response is subsequently studied, and depending upon the response curve, the loudspeaker cabinet is adjusted to help correct for any anomalies that might be present. After the adjustment is complete, the loudspeaker is retested. After the parameters are established, an enclosure assembly can be modified, or designed, and built.

The general external size and shape of the enclosure assembly is conventional, based on the application environment or consumer requirements. That is to say, the conventional size of a hearing aid, a household speaker, auditorium speaker or the like can be used.

After a external size and shape is selected, an optimum cavity design is ascertained. After a cavity design is selected, the individual voids of each cavity forming layer are selected. The voids are defined by the inner circumferential surface of the cavity forming layer. As noted, the voids may all be of the same shape and size, but having the shape of different edge configurations to produce the desired cavity. Several voids may be of a different shape, size or both.

In one embodiment, the inner circumferential surfaces include two alternatively angled surfaces, resembling a tooth of a saw tooth pattern. The surfaces are angled with respect to the plane of the layers. Once assembled as a unit, the saw tooth patterns may have generally the same diameter from the driver support to the end piece. Conversely, the patterns may increase, decrease, or vary in diameter from the driver support to the end piece. By selecting the appropriate sizes and shapes for the voids, and the appropriate number of layers, one can create a cavity in which peaks and valleys of the measured frequency spectrum can be attenuated or accentuated to produce the flattest frequency response in a given application environment. Not wanting to be bound by theory, the amount of attenuation or accentuation of certain frequencies is dependent on the height and angle of the machined inner circumferential edge. Regardless, the shape of the walls of the cavity break up standing waves that might set-up in the enclosure, and eliminate cabinet resonance.

Once the enclosure size, cavity size and shape, and void size are determined, the enclosure is constructed and assembled by conventional methods. The voids within the structural layers may be created by machining, stamping, laser cutting, or created by any other suitable method.

The enclosure assembly must next be operated within the application environment. Upon operation, sound response waves are recorded on a spectrum analyzer, or similar conventional device. Based on the results of the readings, one or more cavity forming layers are removed. Upon removal, the inner circumferential edge of the layer is machined to change the shape of the void within the layer. The selected shape of the void is dependent on the loudspeaker enclosure, the room shape, and consumer input. A spherical shape may be optimal and offers no standing waves. After modifying is complete, the layer is reinstalled. Alternatively, layers may be substituted with other layers having voids of different size, shape or edge configuration.

In addition or alternatively, cavity forming layers may be replaced with solid structural layers to decrease the size of the cavity. Solid structural layers may be replaced with cavity forming layers to increase the size of the cavity. The method of the present invention allows for adjustability to achieve a desired sound performance for a variety of application environments. Further, the method steps of the present invention may be performed in a remote location prior to installation in an application environment. Measurements may be taken ahead of time allowing the speaker to be built off-site prior to installation. In one embodiment, the method steps are performed on site within the application environment. This invention allows for efficient installation of a tailored audio system.

DETAILED DESCRIPTION OF THE PREFERRED EMBODIMENTS

An enclosure assembly 10 according to the present invention is illustrated in FIG. 1. As shown in FIG. 1, the enclosure assembly 10 comprises a driver support 12, a plurality of cavity forming layers 14*a*, 14*b*, 14*c*, 14*d*, 14*e*, 14*f*, 14*g*, 14*h*, 14*i*, (hereinafter, a cavity layer will be generally referred to as 14), and an end piece 16. The embodiment illustrated in FIG. 1 also includes a driver 20, a tweeter 22, and a second order crossover 24.

The driver support 12 is a structural member including a concave opening through which at least a portion of the driver can be disposed and generally forms a front facing surface 26 of the enclosure assembly 10. The driver support 12 has a front and a rear and is adapted to mount a driver 20. In the embodiment shown, the driver 20 is a 5.25 inch woofer. During operation of the speaker, the enclosure loads the driver and allows different alignments for the particular driver and also allows change in the resonance of the enclosure. By "loading" the driver, the driver support provides a surface into which the vibrations of the driver 20 are absorbed. The loading of the driver sets up rearward advancing sound waves in the enclosure 10.

The cavity forming layers 14 are disposed rearward of the driver support 12. The layers 14 comprise an outer peripheral edge 28*a* and an inner circumferential surface 28*b*. The layers further comprise a void disposed inward of the outer peripheral edge 28*a*, and defined by the inner circumferential surface 28*b*.

Figure 1B:
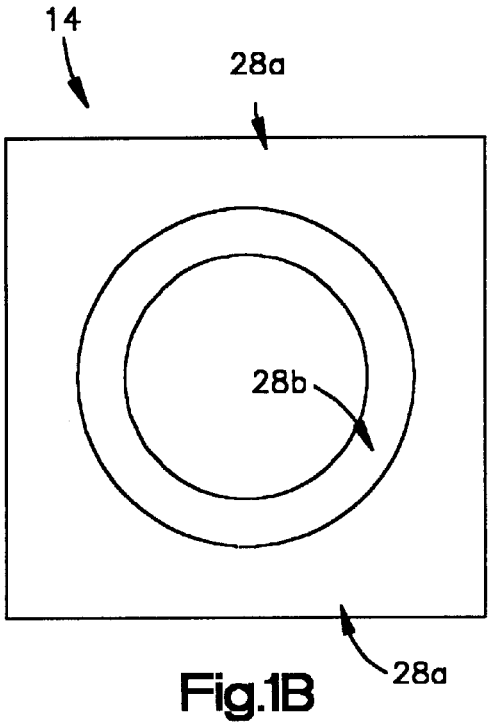
FIG. 1B is a vertical plan view of a cavity forming layer of the present invention; showing a layer which cooperates to form a generally cylindrical shaped cavity.

Referring to FIG. 1B, a cavity forming layer 14 of the present invention is illustrated. The inner circumferential surface 28*b* forms a single tooth of a larger saw tooth pattern, as defined by the plurality of layers in cooperation. The tooth pattern may be disposed along a portion of the circumference of the void, or as illustrated in FIG. 1B, along the entire circumference of the void. A single tooth may form a portion of a saw tooth pattern upon a surface of a cavity.

Referring now to FIGS. 1C–1G, various cavity forming layers 14 of the present invention are illustrated. Vertical plan views show layers which cooperate with like-shaped layers to form a variety of shaped cavities. The cavity forming layers as illustrated form rectangular, oval, triangular, and various irregular shaped cavities, respectively. It should be appreciated by those skilled in the art that FIGS. 1B–1G are provided for purposes of example. Other cavity forming layer shapes and patterns may be apparent to one skilled in the art in view of this disclosure. Therefore, it is to be understood that, within the scope of the appended claims, other layer shapes and patterns can be utilized when practicing the invention otherwise than as specifically shown and described.

Figure 1C:
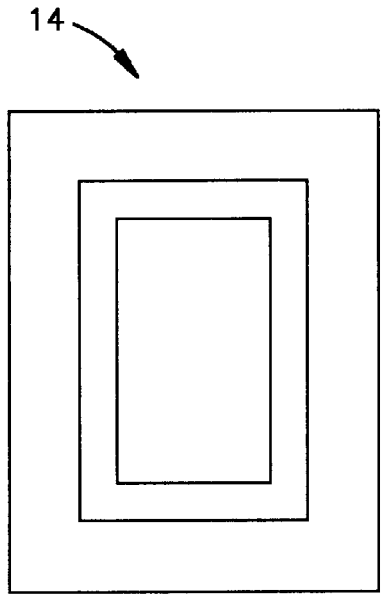
FIGS. 1C–1G are vertical plan views of a cavity forming layer of the present invention; showing layers which cooperates with like layers to form a variety of shaped cavities, e.g., rectangular, oval, triangular, irregular, and irregular, respectively.
Figure 1D:
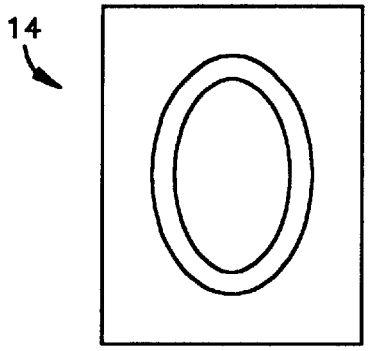
Figure 1E:
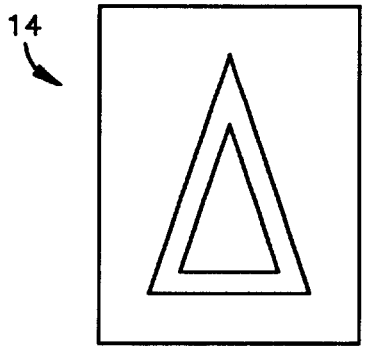
Figure 1F:
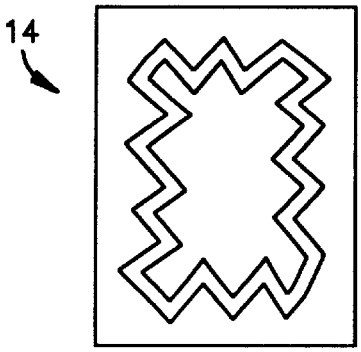
Figure 1G:
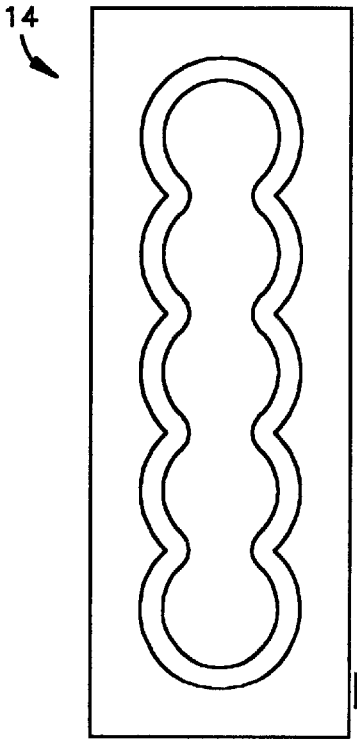
Figure 1H:
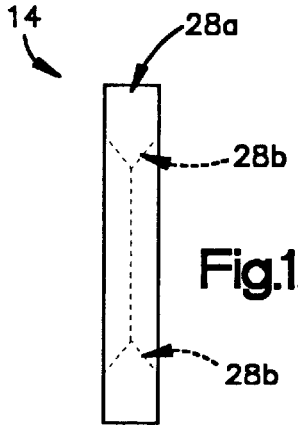
FIG. 1H is a vertical side view of the cavity forming layer shown in FIG. 1B, showing an inner circumferential surface machined as an individual saw tooth.

Referring to FIG. 1H, the cavity forming layer 14 of FIG. 1B is illustrated in a side sectional view. The tooth is machined at an angle α to the plane of the layer. As shown in FIG. 1C, this angle is 45°. Embodiments that feature other angles ranging from 0° to 90°. as well as curves, such as parabolas or half-moon patterns, and a variety of other machining patterns suitable for use in accordance with the invention. The layers 14 as shown in FIG. 1 are about 0.5 to 3.0 inches thick and are constructed from wood. It will, however, be apparent to those of ordinary skill in the art that the thickness can be any thickness depending on the size and dimensions of the speaker unit, the materials used and the number of layers.

Referring again to FIG. 1A, the enclosure assembly 10 comprises an end piece 16 disposed adjacent a rearward most cavity forming layer 14i. The end piece 16 cooperates with the voids of cavity forming layers 14 to form a cavity 21. In the embodiment illustrated in FIG. 1A, a single end piece 16 is utilized to form a single cavity 21 in cooperation with the cavity forming layers 14 rearward of the driver 20. The end piece can be cup-shaped, flat, or any other shape apparent to others with ordinary skill in the art in view of this disclosure.

The enclosure assembly 10 as illustrated in FIG. 1A is a 0.1 cubic foot enclosed cabinet. During testing, the enclosure assembly 10 was measured for frequency response using a AudioControl model SA-3052 ⅓ octave real time spectrum analyzer per accepted techniques in the art and previously discussed. The assembly shown in FIG. 1A showed a frequency response of 50 to 20,000 Hz +/−3 dB. Low colonization due to cabinet resonance was detected. The colonization was barely perceptible by feel to the human hand. A condition of high colonization can act as a second radiating source, either in or out of phase, either reinforcing or canceling certain frequencies imparting distortions.

Figure 2:
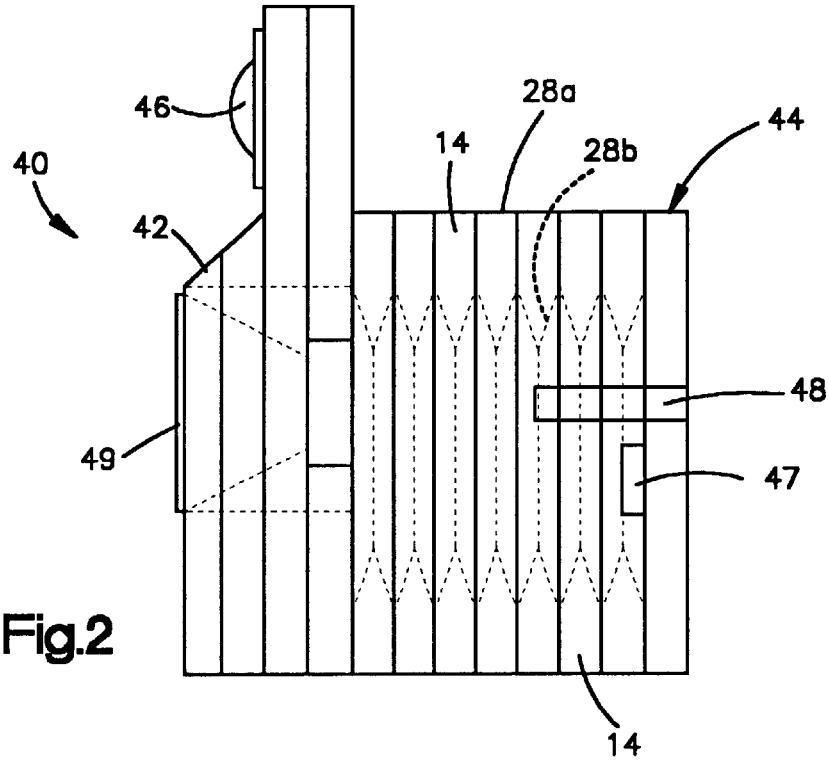
FIG. 2 is a vertical sectional view of a second enclosure assembly of the present invention; showing inner circumferential surfaces forming an exaggerated saw-tooth pattern.

Referring now to FIG. 2, a second embodiment of the present invention is illustrated. As shown in FIG. 2, the enclosure assembly 40 comprises a driver support 42, a plurality of cavity forming layers 14, and an end piece 44. The embodiment illustrated in FIG. 2 also includes a 1 inch tweeter 46, a second order crossover 47, a 2 inch diameter port 48 and a driver 49. The driver as shown is a 5.25 inch woofer 49.

The cavity forming layers 14 are disposed rearward of the driver support 42. The layers 14 comprise an outer peripheral edge 28*a* and an inner circumferential surface 28*b*. The layers further comprise a void disposed inward of the outer peripheral surface 28*a*, and defined by the inner circumferential surface 28*b*.

The embodiment shown in FIG. 2 comprises cavity forming layers 14 wherein the inner circumferential surface 28*b* has been machined at a decreased angle relative to the plane of the layer. As shown in FIG. 2, the saw tooth pattern has teeth formed at an increased acute angle, with respect to the embodiment shown in FIGS. 1A–1C. With respect to the plane of the layer, the inner circumferential surface 28*b* is machined at an angle equal to or less than 45°. In this embodiment, the machined angle is 45°.

The enclosure assembly 40 as illustrated in FIG. 2 is a 0.22 cubic foot enclosed cabinet. During testing, the enclosure assembly 40 was measured for frequency response using a AudioControl model SA-3052 ⅓ octave real time spectrum analyzer. The assembly shown in FIG. 2 showed a frequency response of 40 to 20,000 Hz +/−3 dB. Low colonization due to cabinet resonance was detected.

Figure 3:
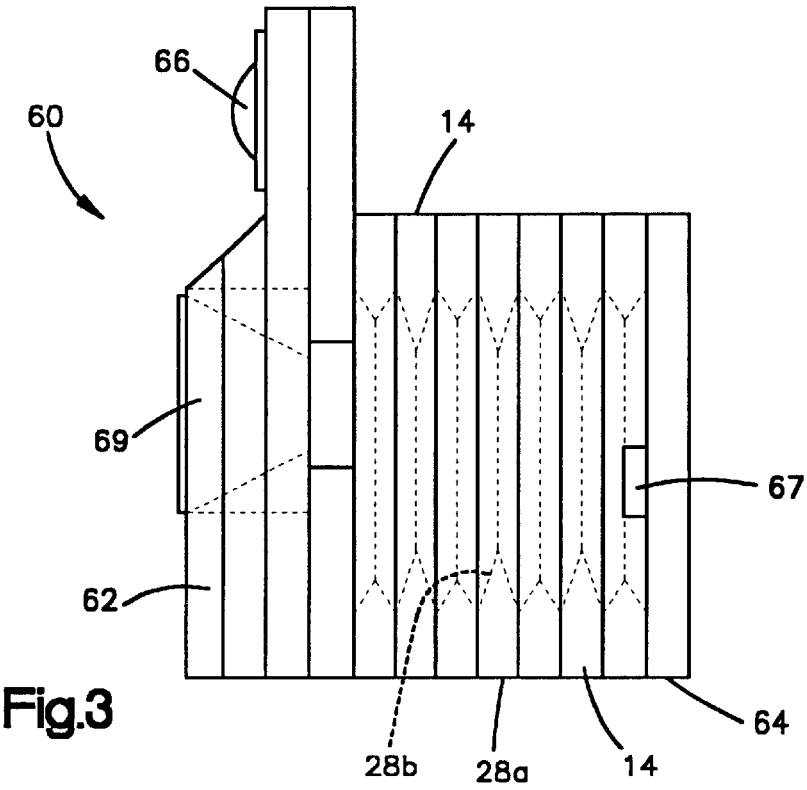
FIG. 3 is a vertical sectional view of a third enclosure assembly of the present invention, showing inner circumferential surfaces forming an irregular saw-tooth pattern.

Referring to FIG. 3, a third embodiment of the present invention is illustrated. The embodiment resembles the embodiment illustrated in FIG. 1, but features an inner circumferential surface having an irregular saw tooth pattern.

As shown in FIG. 3, the enclosure assembly 60 comprises a driver support 62, a plurality of cavity forming layers 14, and an end piece 64. The embodiment illustrated in FIG. 3 also includes a 1 inch tweeter 66, a first order crossover 67, and a driver 69. The driver as illustrated is an 8 inch woofer 69.

The cavity forming layers 14 are disposed rearward of the driver support 62. The layers 14 comprise an outer peripheral edge 28*a* and an inner circumferential surface 28*b*. The layers further comprise a void disposed inward of the outer circumferential surface 28*a*.

The embodiment shown in FIG. 3 comprises cavity forming layers 14 wherein the inner circumferential surfaces 28*b* have been machine at a variety of angles relative to the plane of the layer. Accordingly, the cross-section area of each cavity forming layer may vary. As shown in FIG. 3, an irregular, non-repetitive saw tooth pattern has teeth formed, as compared to the embodiment shown in FIGS. 1A and 2. With respect to the plane of the layer, the inner circumferential surface 28*b* is machined at angles ranging from about 30° to 45°.

Figure 4:
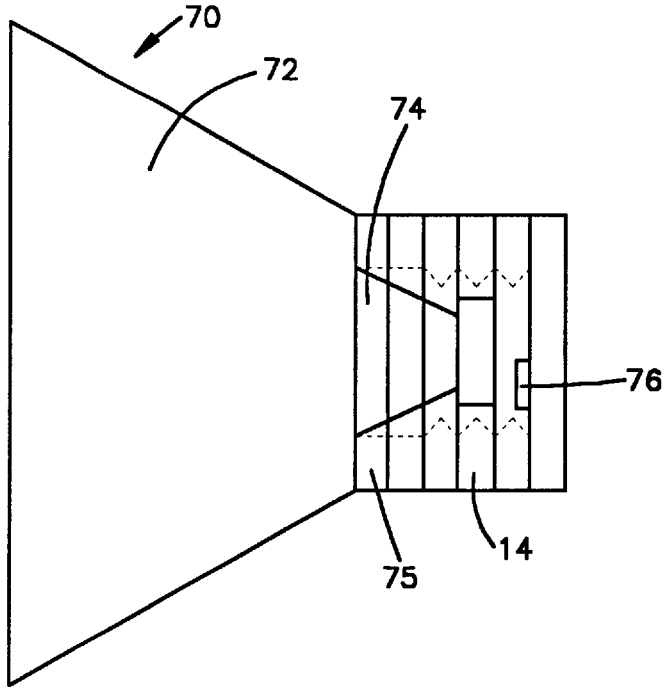
FIG. 4 is a vertical sectional view of a fourth enclosure assembly of the present invention, showing use of the enclosure in a horn assembly.

The enclosure assembly of the present invention is not limited to household speaker embodiments. For example, the enclosures can be used for bass reflex loudspeaker systems, band pass loudspeaker systems, passive radiator loudspeaker systems, horn loaded systems, and other systems apparent to those with ordinary skill in the art in view of this disclosure. Referring to FIG. 4, another embodiment of the present invention is illustrated. A horn loaded system 70 is illustrated in FIG. 4. The system 70 comprises a horn 72, a woofer 74 of suitable size, a driver support 75 and a plurality of cavity forming layers 14. Conventional hardware may be used to mount the woofer 74 to the driver support 75. The horn 72 can be configured to different flare rates such as hyperbolic, exponential, or tractrix. The enclosure 70 as shown includes a single cavity.

Figure 5A:
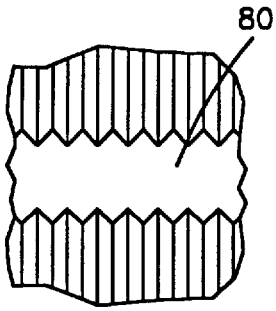
FIGS. 5A–5G are a series of partial sectional views of a cavity, showing various inner circumferential cavity surfaces.
Figure 5B:
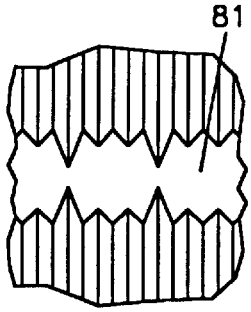

Referring to FIGS. 5A to 5G, a series of partial sectional views of various cavities 80, 81, 82, 83, 84, 85, 86 are illustrated, showing various inner circumferential cavity surfaces. FIG. 5A shows an inner circumferential surface of a cavity 80 resembling a saw tooth pattern. The individual inner circumferential surfaces of each cavity forming layer are machined in a convex tooth pattern. The opposing angles on each tooth with respect to the plane of the layer are approximately the same. FIG. 5B shows an inner circumferential surface of a cavity 81 resembling an irregular saw tooth pattern.

Figure 5C:
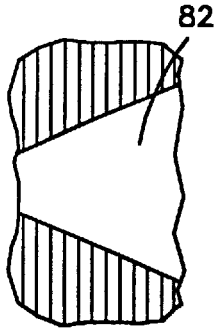
Figure 5D:
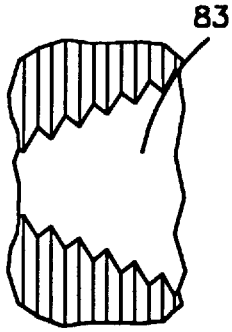

FIG. 5C shows an inner circumferential surface of a cavity 82 resembling a linearly increasing conical pattern. The inner circumferential surface of each cavity forming layer is angled to created a cavity increasing in diameter rearward of the driver support. FIG. 5D shows an inner circumferential surface of a cavity 83 resembling a conical pattern. The inner circumferential surface of each cavity forming layer are irregularly angled. The layers created a cavity generally increasing in diameter rearward of the driver support.

Figure 5E:
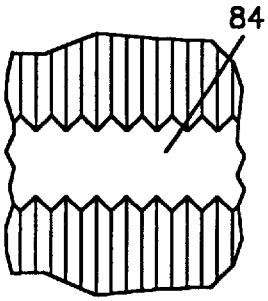

FIG. 5E shows an inner circumferential surface of a cavity 84 resembling an irregular curved pattern. The inner circumferential surface of each cavity forming layer is curved to created a cavity first increasing in diameter rearward of the driver support, then decreasing in diameter. Other generally and irregularly curved patterns should be apparent to others with ordinary skill in the art in view of this disclosure.

Figure 5F:
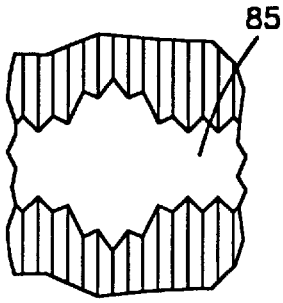

FIG. 5F shows a similar inner circumferential surface of a cavity 85 resembling an irregular angled pattern. The inner circumferential surface of each cavity forming layer is angled to created a cavity first generally increasing in diameter rearward of the driver support, then generally decreasing in diameter.

Figure 5G:
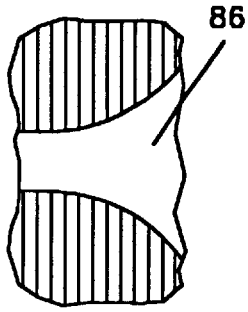

FIG. 5G shows an inner circumferential surface of a cavity 86 resembling an exponential curved pattern. The inner circumferential surface of each cavity forming layer is curved to created a cavity first increasing slowly in diameter rearward of the driver support, then increasing rapidly in diameter.

Figure 6A:
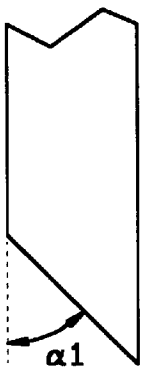
FIGS. 6A–6J are a series of partial sectional views of a portion of a cavity forming layer, showing various inner circumferential surfaces of cavity forming layers.
Figure 6B:
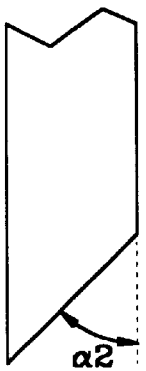

The inner circumferential cavity surface pattern is determined by the size of the cabinet, the driver to be used, and the response that is desired within the specific application environment. Other patterns suitable for use in the invention would be apparent to others with ordinary skill in the art in view of this disclosure Referring to FIGS. 6A to 6J, a series of partial sectional views of various individual cavity forming layers are illustrated, showing various inner circumferential surfaces. FIG. 6A shows a cavity forming layer with an inner circumferential surface angled rearward from the driver support at $\alpha 1$ degrees. As shown, $\alpha 1$ is about 45°. This angle may range from 0° to 90°. FIG. 6B shows a cavity forming layer with an inner circumferential surface angled forward toward the driver support at $\alpha 2$ degrees. As shown, $\alpha 2$ is about 45°. As stated, this angle may range from 0° to 90°.

Figure 6C:
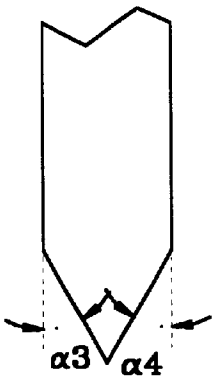

FIG. 6C shows a cavity forming layer with an inner circumferential surface angled to form a convex tooth-shaped surface. The surface is formed by the angles $\alpha 3$ and $\alpha 4$. These two angles may be of the same value, or they may be different. As shown, $\alpha 3$ and $\alpha 4$ are each about 45°. These two angles may independently or dependently range from 0° to 90°.

Figure 6D:
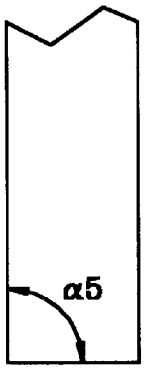

FIG. 6D shows a cavity forming layer with an inner circumferential surface perpendicular to the plane of the cavity forming layer. That is to say, $\alpha 5$ is about 90° as illustrated in FIG. 6D.

Figure 6E:
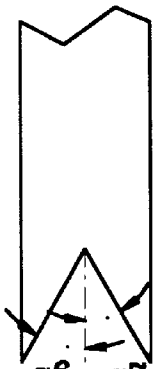

FIG. 6E shows a cavity forming layer with an inner circumferential surface angled to form a concave tooth-shaped surface. The surface is formed by the angles $\alpha 6$ and $\alpha 7$. These two angles may be of the same value, or they may be different. As shown, $\alpha 6$ and $\alpha 7$ are both 45°. These two angles may independently or dependently range from 0° to 90°.

Figure 6F:
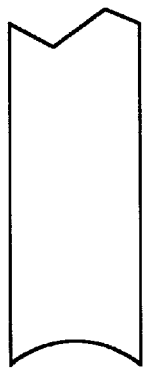
Figure 6G:
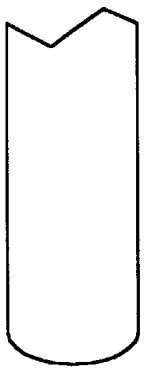
Figure 6H:
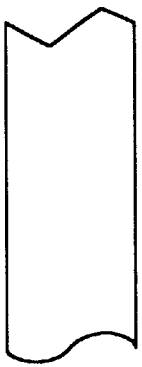

FIG. 6F shows a cavity forming layer with an inner circumferential surface curved to form a concave-shaped surface. In contrast, FIG. 6G shows a cavity forming layer with an inner circumferential surface curved to form a convex-shaped surface. In yet another embodiment, FIG. 6H shows a cavity forming layer with an inner circumferential surface curved to form a surface that includes a convex portion and a concave portion.

Figure 6I:
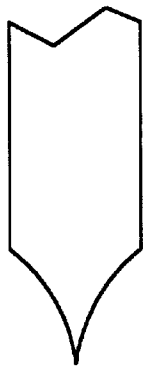
Figure 6J:
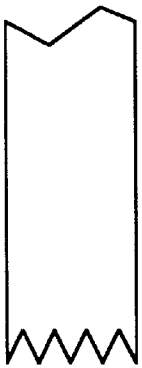
Figure 7A:
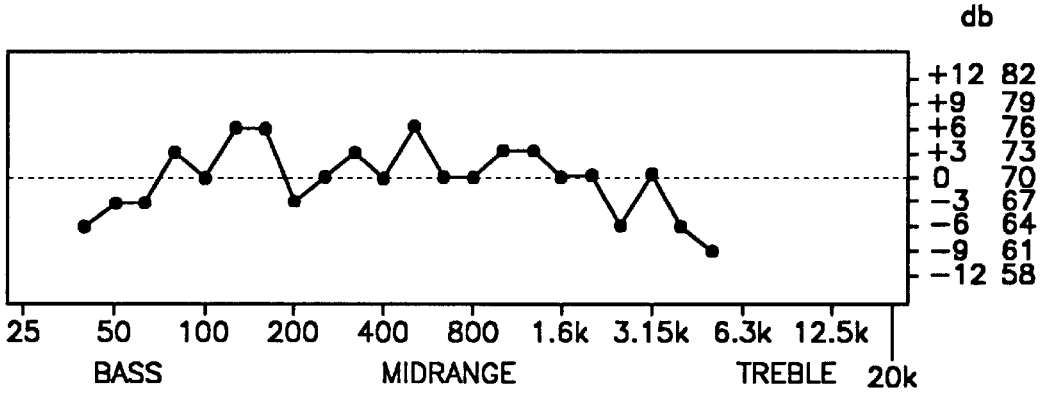
FIGS. 7A–7E are a series of graphs of experimental data measured during testing of one prototype example assembled in accordance with the present invention.
Figure 7B:
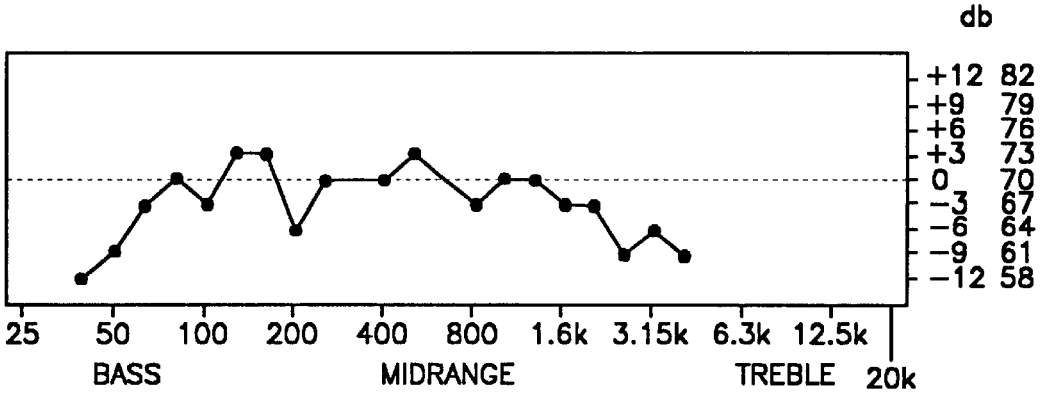
Figure 7C:
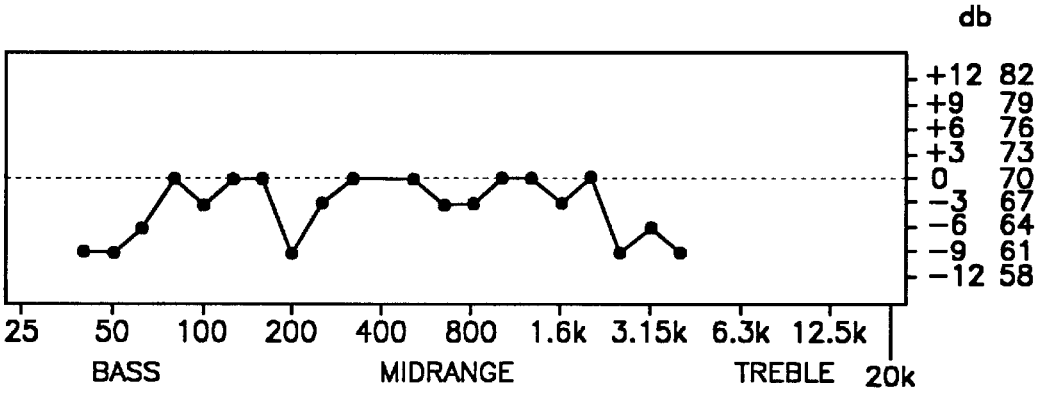
Figure 7D:
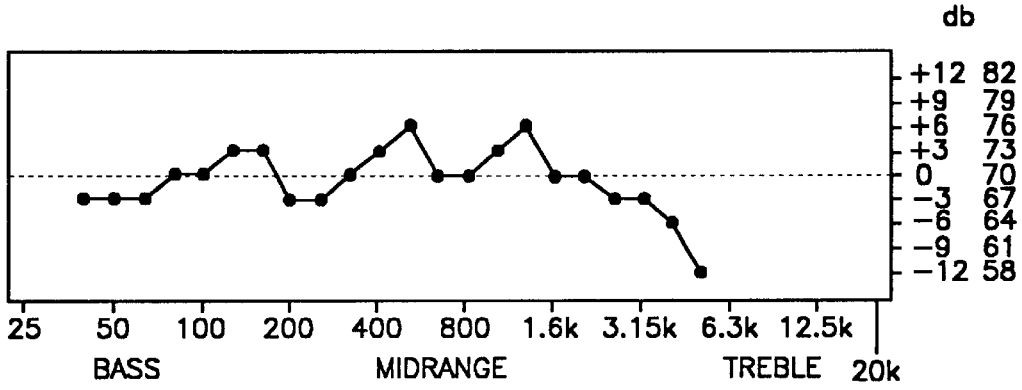
Figure 7E:
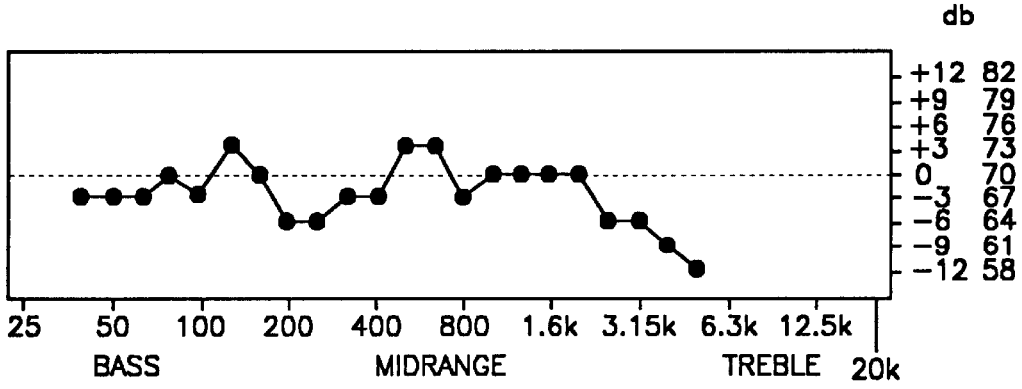
Figure 8A:
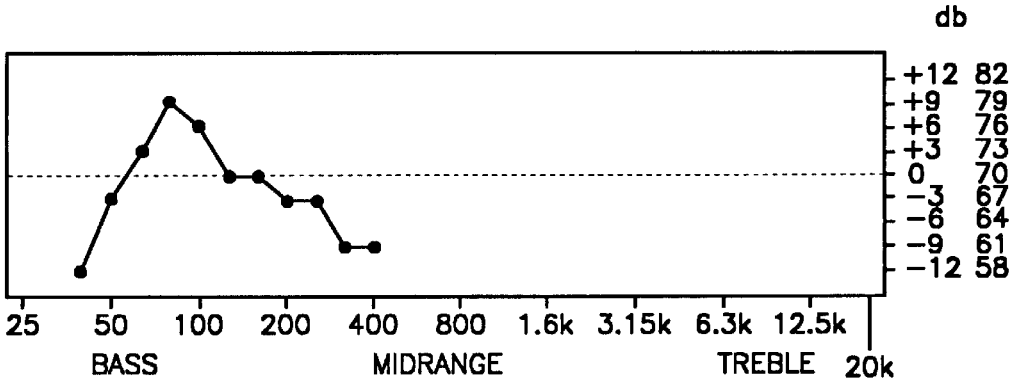
FIGS. 8A–8E are a series of graphs of experimental data measured during testing of a second prototype example assembled in accordance with the present invention.
Figure 8B:
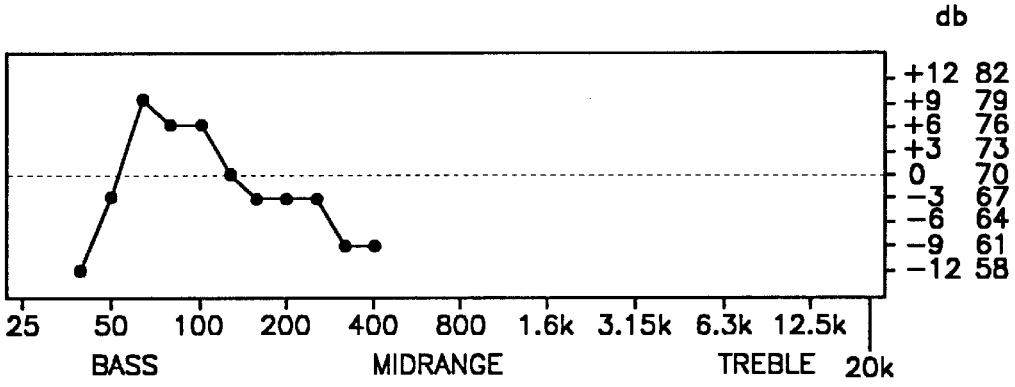
Figure 8C:
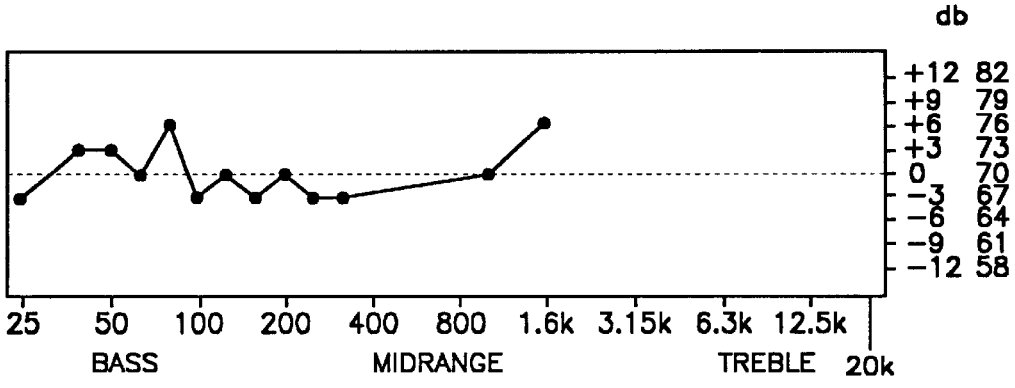
Figure 8D:
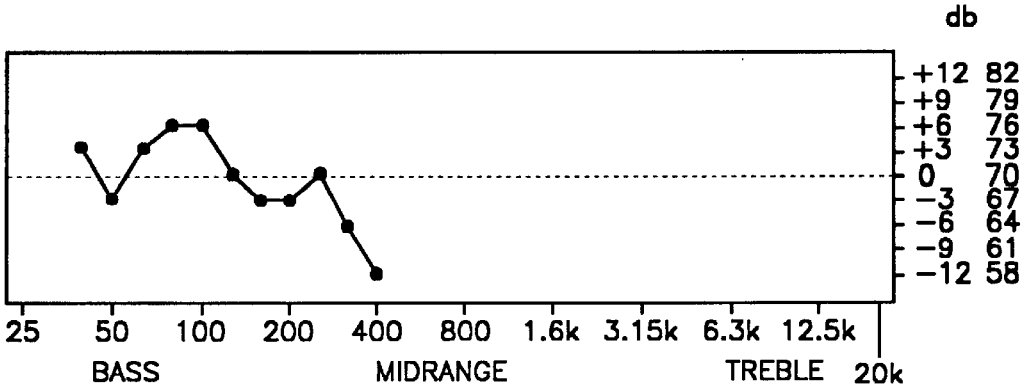
Figure 8E:
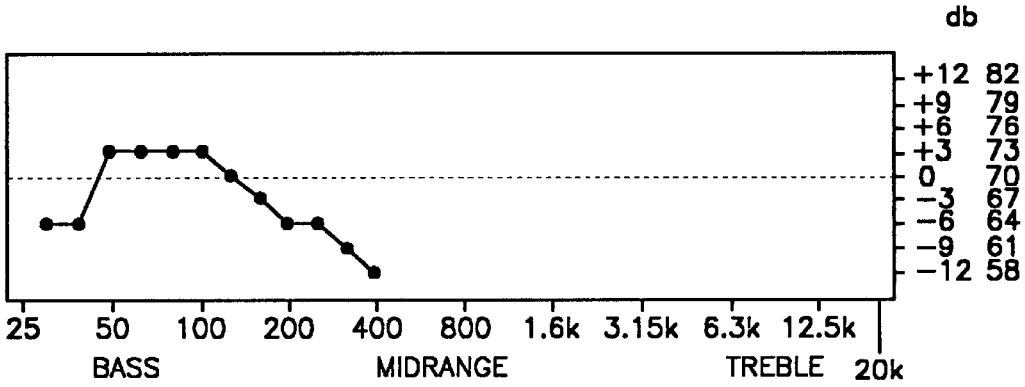

FIG. 6I shows a cavity forming layer with an inner circumferential surface having a exponentially shaped tooth. In yet another embodiment, FIG. 6J shows a cavity forming layer with an inner circumferential surface formed to include a saw-tooth pattern.

It should be appreciated by those skilled in the art that FIGS. 5A–5G and FIGS. 6A–6J are provided for purposes of example. Other surface shapes and patterns may be apparent to one skilled in the art in view of this disclosure. Therefore, it is to be understood that, within the scope of the appended claims, other surface shapes and patterns can be utilized when practicing the invention otherwise than as specifically shown and described.

Experimental examples of the present invention will now be discussed.

Experimental Data

EXAMPLE 1

For purposes of example only, a speaker in accordance with the present invention was constructed and tested. The speaker comprised an eight inch woofer loaded with a 1.5 inch diameter port sub woofer that was five inches long. The speaker type is conventionally referred to as an acoustic suspension system. The woofer was attached to a front driver support while the port was attached to a rear end piece. The driver support and end piece were separated by several cavity forming layers. During iterations in testing, the cavity enclosure was increased in size by adding cavity forming layers.

The cavity forming layers used in Example 1 are of the type illustrated in FIG. 1B and FIG. 1H. The exterior dimensions of the layer form a 12" by 12" square. The layers are about 0.75" thick and constructed from wood. The inner circumferential edges of the cavity are angled at 45° with respect to the plane of the layer. The edge forms a saw-tooth pattern as illustrated in FIG. 6C. The internal diameter of the inner point of the saw-tooth was about 9".

At each iteration, the frequency response of the enclosure was tested using an AudioControl Industrial SA-3052 real time spectrum analyzer. A microphone was placed two meters from the subwoofer, which itself was placed in one corner of the application environment. Example 1 was conducted within a 3,000 cubic foot room. The acoustical parameters were similar to a room in a conventional residential house.

Table 1 that follows summarizes the data collected in this example, including the number of layers used and the volume of the enclosure formed. The frequency responses of the enclosure at each iteration are illustrated in FIGS. 7A–7E.

TABLE 1

Example 1 Summary

| FIG. | Number of Layers | Volume (cubic ins) | Frequency Response below 100 Hz |
|---|---|---|---|
| 7A | 10 | 520 | 40–100 Hz +/– 4.5 dB |
| 7B | 11 | 572 | 40–100 Hz +/– 6 dB |
| 7C | 12 | 624 | 40–100 Hz +/– 4.5 dB |
| 7D | 13 | 676 | 40–100 Hz +/– 1.5 dB |
| 7E | 14 | 728 | 40–100 Hz +/– 1.5 dB |

The speaker used in Example 1 contains one cavity. The above data shows that increasing the size of the cavity by the addition of cavity forming layers tends to tighten the frequency response. In other words, the tolerance of the response decreases as additional layers are added.

EXAMPLE 2

For purposes of example only, the speaker of Example 1 was tested again in a different test environment using different equipment. In this example, the speaker was driven by a Dolby Digital LFE signal with a 100 Hz low pass crossover signal. Again, during iterations in testing, the cavity enclosure was increased in size by adding cavity forming layers.

At each iteration, the frequency response of the enclosure was tested using an AudioControl Industrial SA-3052 real time spectrum analyzer. A microphone was placed two meters from the subwoofer, which itself was placed in one corner of the room. Example 2 was conducted within a 2,000 cubic foot room. Table 2 that follows summarizes the data collected in this example. The frequency responses of the enclosure at each iteration are illustrated in FIGS. 8A–8E.

TABLE 2

Example 2 Summary

| FIG. | Number of Layers | Volume (cubic ins) | Frequency Response below 100 Hz |
|---|---|---|---|
| 8A | 10 | 520 | 40–100 Hz +/– 10.5 dB |
| 8B | 11 | 572 | 40–100 Hz +/– 10.5 dB |
| 8C | 12 | 624 | 40–100 Hz +/– 4.5 dB |
| 8D | 13 | 676 | 40–100 Hz +/– 4.5 dB |
| 8E | 14 | 728 | 40–100 Hz +/– 4.5 dB |

The speaker used in Example 2 contains one cavity. The above data also suggests that increasing the size of the cavity by the additional of cavity forming layers tends to tighten the frequency response.

EXAMPLE 3

For purposes of example only, another speaker in accordance with the present invention was constructed and tested. The speaker comprised a 5.25 inch polypropylene woofer loaded with an Acoustic Suspension, also known in the art as a closed box system. The woofer was attached to the front driver support while the port was attached to the back end piece. The driver support and the end piece were separated by several cavity forming layers. During iterations in testing, the cavity enclosure was increased in size by adding cavity forming layers.

The cavity forming layers used in Example 3 are similar to the type illustrated in FIG. 1C. The exterior dimensions of the layer form a 8" wide by 12" high rectangle. The layers are about 0.75" thick and constructed from birch plywood. The inner circumferential surface forms a 5" wide by 9" high rectangle. The inner circumferential edges of the cavity are angled at 90° with respect to the plane of the layer. The edge forms a pattern as illustrated in FIG. 6D.

At each iteration, the frequency response of the enclosure was tested using a LMS spectrum analyzer manufactured by Linear X. A microphone was placed one meter from the loudspeaker. The speaker was placed generally in the center of the room. Example 3 was conducted within a 2,500 cubic foot room.

Figure 9A:
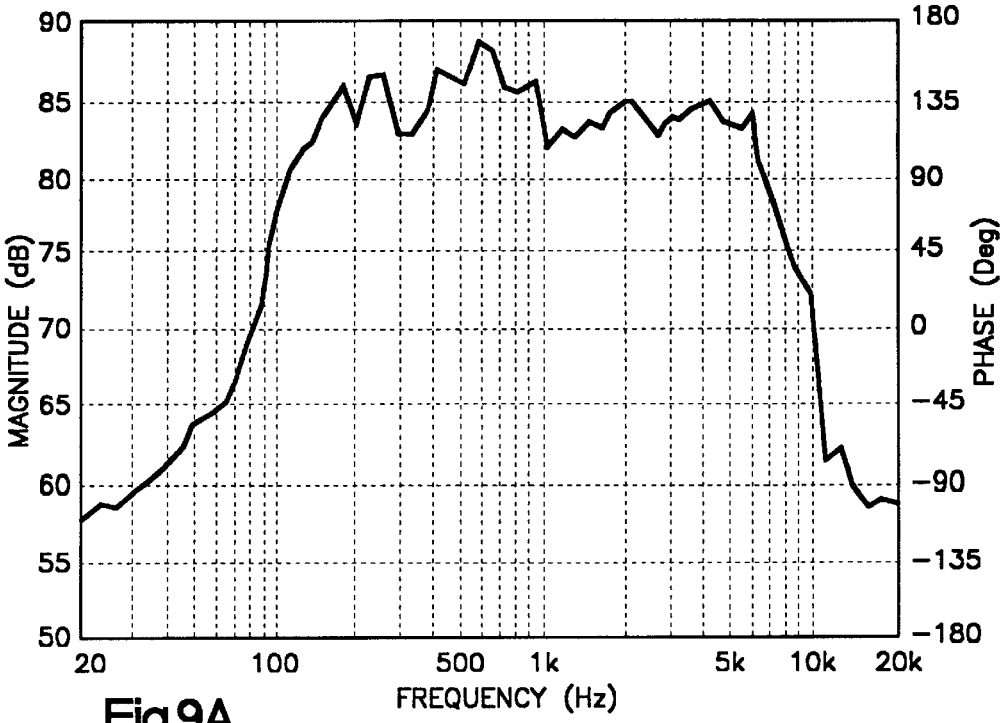
FIGS. 9A–9B are a series of graphs of experimental data measured during testing of a third prototype example assembled in accordance with the present invention.
Figure 9B:
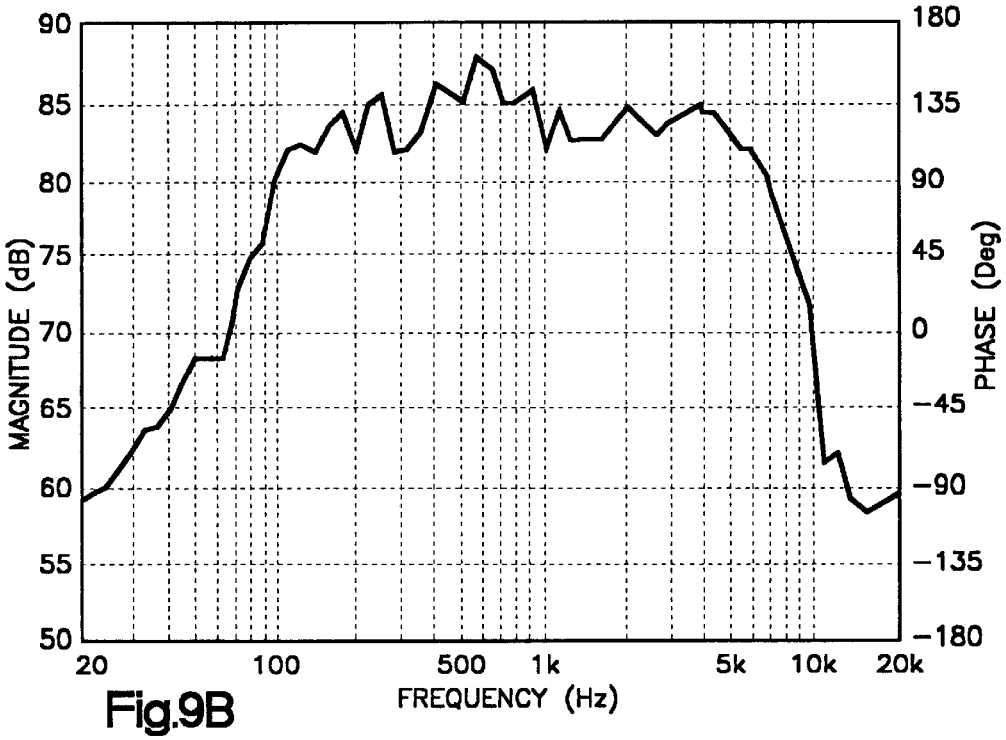

The continuous, full spectrum, frequency responses of the enclosure at each iteration are illustrated in FIGS. 9A–9B. Two iterations were conducted in Example 3. The first iteration tested the enclosure with 3 layers (see FIG. 9A) and the second iteration tested the enclosure with 7 layers (see FIG. 9B). The enclosure formed of three layers was about 101 cubic inches in volume. The enclosure formed from seven layers was about 236 cubic inches. As seen from the results, increasing the layers improved the lower cut off frequency from 110 Hz to 80 Hz.

EXAMPLE 4

Example 4 repeated the tests conducted in Example 3, but with a modified enclosure. In the exemplary embodiment constructed in Example 4, cavity forming layers were used having inner circumferential surfaces similar to the surface shown in FIG. 6C. In other words, the inner circumferential surfaces of the layers were machined at angles at or near 45°.

Figure 10A:
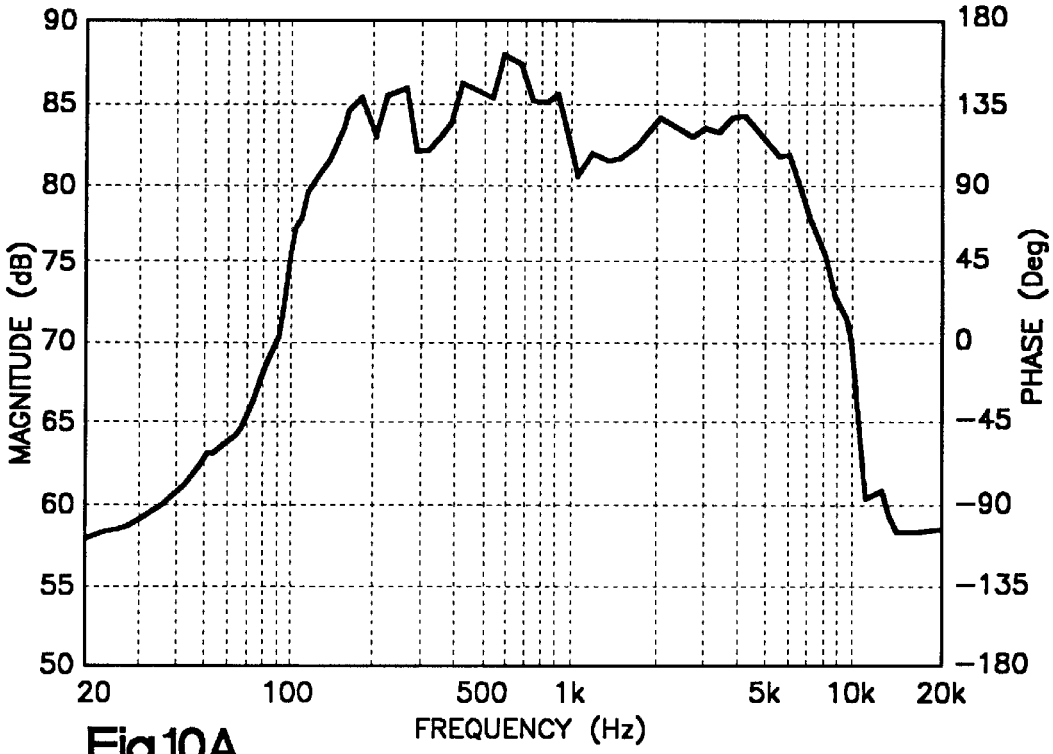
FIGS. 10A–10B are a series of graphs of experimental data measured during testing of a fourth prototype example assembled in accordance with the present invention.
Figure 10B:
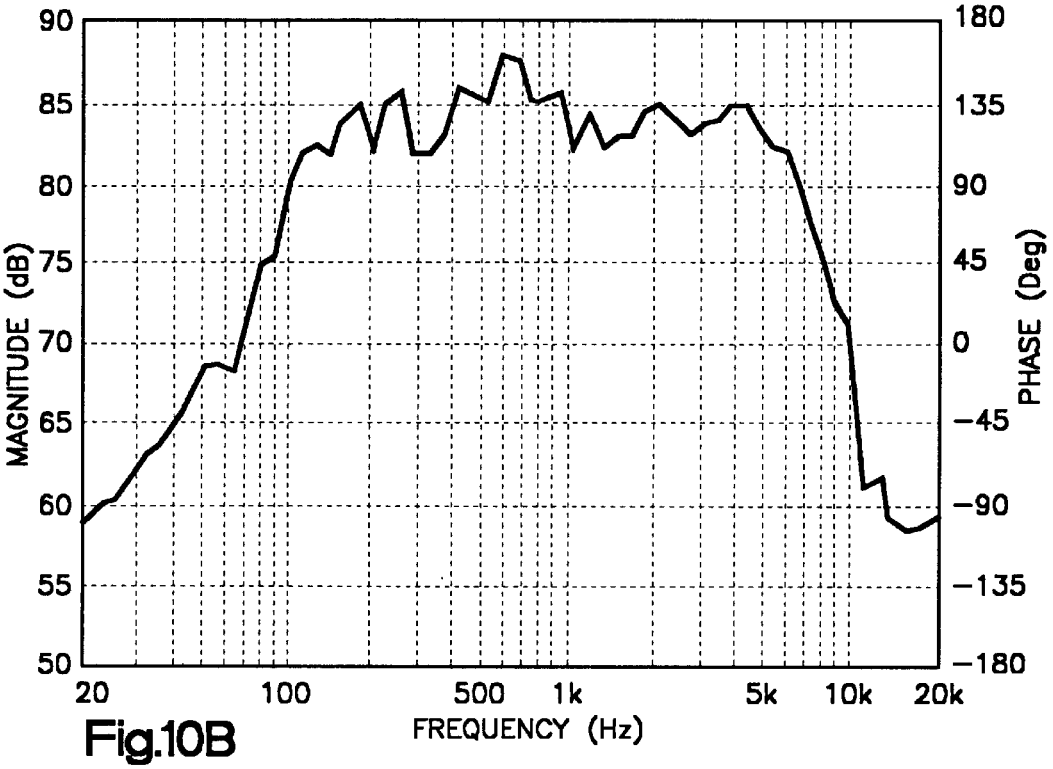

The frequency responses of the enclosure at each iteration are illustrated in FIGS. 10A–10B. Two iterations were also conducted in Example 4. The first iteration tested the enclosure with 3 layers (see FIG. 10A) and the second iteration tested the enclosure with 7 layers (see FIG. 10B). The enclosure formed of three layers was about 112 cubic inches in volume. The enclosure formed from seven layers was about 263 cubic inches. By using layers machined at 45°, the response was flattened by about +/−1.0 dB for the enclosure with 3 layers, and by about +/−0.5 dB for the enclosure with 7 layers, as seen by comparing FIGS. 9A to 10A, and FIGS. 9B to 10B, respectively.

Many variations and modifications of the invention will be apparent to those skilled in the art from the above detailed description of the preferred embodiment. Therefore, it is to be understood that, within the scope of the appended claims, the invention can be practiced otherwise than as specifically shown and described.

What is claimed is:

1. An enclosure assembly for use in an audio speaker comprising:

a driver having a center axis;

a driver support having a front and a rear and adapted to support a driver;

a plurality of cavity forming layers disposed rearward of said driver support; and an end piece disposed adjacent a rearward most cavity forming layer;

each said cavity forming layer comprising an outer peripheral edge and a void disposed inward of said outer peripheral edge, wherein said void is defined by an inner circumferential edge;

said cavity forming layers being removably joined such that said inner circumferential edges of said voids and said end piece cooperate to form a single cavity rearward of said driver support for modifying rearward advancing soundwaves, said cavity having an inner circumferential surface defined by the inner circumferential edges of said cavity forming layers, wherein said inner circumferential edges are contiguous;

wherein individual cavity forming layers can be added or removed to change a volume of said single cavity.

2. The assembly according to claim 1 wherein said cavity forming layers are substantially planar and said inner circumferential edges of said voids cooperate to form a generally cylindrical cavity having an axis extending transversely to the plane of said layers.

3. The assembly according to claim 1 wherein each said void in each said cavity forming layer has substantially the same area and shape.

4. The assembly according to claim 1 wherein at least one said cavity forming layer has a void having an area that is different from an area of a void of at least one other cavity forming layer.

5. The assembly according to 1 wherein at least one said cavity forming layer has a void having a shape that is different from a shape of a void of at least one other cavity forming layer.

6. The assembly according to claim 1 wherein said cavity forming layers are substantially planar and said inner circumferential edges of said voids cooperate to form a cavity having a longitudinal axis extending transversely to the plane of said layers, and wherein at least one said cavity forming layer has a void having an area that is different from an area of a void of at least one other cavity forming layer.

7. The assembly according to claim 1 wherein said inner circumferential edges are shaped to form a contoured inner circumferential surface.

8. The assembly according to claim 7 wherein a plurality of said circumferential edges are shaped and cooperate to form a generally curved pattern on at least a portion of said contoured inner circumferential surface, wherein at least a portion of said curved pattern is defined by a hyperbolic equation along a direction of said center lengitudinal axis rearward of said driver support.

9. The assembly according to claim 7 wherein a plurality of said circumferential edges are shaped and cooperate to form a generally curved pattern on at a portion of said contoured inner circumferential surface, wherein at least a portion of said curved pattern is defined by an exponential equation along a direction of said center axis rearward of driver.

10. The assembly according to claim 1 wherein a plurality of said circumferential edges are shaped and cooperate to form a saw-tooth pattern on at least a portion of said inner circumferential surface.

11. The assembly according to claim 1 wherein a plurality of said circumferential edges include planar surfaces, wherein a plurality of said surfaces are angled with respect to the plane of said cavity forming layers.

12. The assembly according to claim 1 wherein at least one of said circumferential edges comprises multiple planar surfaces, wherein at least one surface is angled with respect to the plane of said cavity forming layers.

13. The assembly according to claim 12 wherein at least one said cavity forming layer has a void having an area that is different from an area of a void of at least one other cavity forming layer.

14. The assembly according to claim 1 wherein at least one of said circumferential edges comprises a curved surface.

15. The assembly according to claim 14 wherein at least one said cavity forming layer has a void having an area that is different from an area of a void of at least one other cavity forming layer.

16. An enclosure assembly for use in an audio speaker comprising:

a driver having a center axis;

a driver support having a front and a rear and adapted to support a driver;

a plurality of cavity forming layers disposed rearward of said driver support; and an end piece disposed adjacent a rearward most cavity forming layer;

each said cavity forming layer comprising an outer peripheral edge and a void disposed inward of said outer peripheral edge, wherein said void is defined by an inner circumferential edge;

said cavity forming layers being removably joined such that said inner circumferential edges of said voids and said end piece cooperate to form a single cavity rearward of said driver support for modifying rearward advancing soundwaves, said cavity having an inner circumferential surface defined by the inner circumferential edges of said cavity forming layers;

wherein said inner circumferential surface is contoured relative to said center axis.

17. An enclosure assembly for use in an audio speaker comprising:

a driver having a center axis;

a driver support having a front and a rear and adapted to support a driver;

a plurality of cavity forming layers disposed rearward of said driver support; and an end piece disposed adjacent a rearward most cavity forming layer;

each said cavity forming layer comprising an outer peripheral edge and a void disposed inward of said outer peripheral edge, wherein said void is defined by an inner circumferential edge;

said cavity forming layers being removably joined such that said inner circumferential edges of said voids and said end piece cooperate to form a single cavity rearward of said driver support for modifying rearward advancing soundwaves, said cavity having an inner circumferential surface defined by the inner circumferential edges of said cavity forming layers;

wherein a plurality of said inner circumferential edges define planar surfaces angled with respect to said center axis.

18. An enclosure assembly for use in an audio speaker comprising:

a driver having a center axis;

a driver support having a front and a rear and adapted to support a driver;

a plurality of cavity forming layers disposed rearward of said driver support; and an end piece disposed adjacent a rearward most cavity forming layer;

each said cavity forming layer comprising an outer peripheral edge and a void disposed inward of said outer peripheral edge, wherein said void is defined by an inner circumferential edge;

said cavity forming layers being removably joined such that said inner circumferential edges of said voids and said end piece cooperate to form a single cavity rearward of said driver support for modifying rearward advancing soundwaves, said cavity having an inner circumferential surface defined by the inner circumferential edges of said cavity forming layers;

wherein at least one of said inner circumferential edges comprises a curved surface.

* * * * *